US005974075A

United States Patent [19]

Kompan

[11] Patent Number: 5,974,075

[45] Date of Patent: Oct. 26, 1999

[54] METHOD OF MAGNETICALLY-CONTROLLABLE, ELECTROSLAG MELTING OF TITANIUM AND TITANIUM-BASED ALLOYS AND APPARATUS FOR CARRYING OUT SAME

[76] Inventor: Jaroslav Yurievich Kompan, 18-1, bul, Lesi Ukraini, Apt. 14, Kyiv, Ukraine, 252133

[21] Appl. No.: 09/132,121

[22] Filed: Aug. 11, 1998

[51] Int. Cl.[6] ..... H05B 3/60

[52] U.S. Cl. ..... 373/42; 373/67

[58] Field of Search ..... 373/42, 67; 164/469, 164/495, 497; 75/10.18, 10.26; 266/200

[56] References Cited

U.S. PATENT DOCUMENTS

| | | | |
|---|---|---|---|
| 2,640,860 | 6/1953 | Herres | 373/67 |
| 2,686,822 | 8/1954 | Evans et al. | 75/10.26 |
| 2,880,483 | 4/1959 | Hanks et al. | 164/469 |
| 3,067,473 | 12/1962 | Hopkins | 164/497 |
| 3,516,476 | 6/1970 | Scriver | 164/495 |
| 3,619,464 | 11/1971 | Holzgruber et al. | 373/49 |
| 3,713,808 | 1/1973 | Wallbaum et al. | 75/10.18 |
| 4,264,062 | 4/1981 | Clark et al. | 266/200 |
| 4,610,296 | 9/1986 | Hiratake et al. | 164/469 |
| 5,127,468 | 7/1992 | Poulsen | 164/495 |

*Primary Examiner*—Teresa Walberg
*Assistant Examiner*—Quang Van
*Attorney, Agent, or Firm*—Hovey, Williams, Timmons & Collins

[57] ABSTRACT

A method of magnetically-controllable, electroslag melting of titanium and titanium-based alloys which provides high homogeneity over substantially the total ingot length is provided. The homogeneity of the ingot is achieved by maintaining the maximum permissible values of electrode gap and consumable electrode feed rate substantially constant. The value of the melting current increases due to the decreasing melting voltage. The direction and intensity of magnetically-controllable, toroidal rotation are kept substantially constant by maintaining the melting current and electrode gap at substantially constant values. The quality of the metal was increased due to the reduction of harmful gas inclusions by using the fluoride-chloride flux. This metal purification is optimized by the toroidal rotation of melt. Smooth regulation of the melt direction is provided by using the device for stabilizing the melting current.

3 Claims, 2 Drawing Sheets

METHOD OF MAGNETICALLY-CONTROLLABLE, ELECTROSLAG MELTING OF TITANIUM AND TITANIUM-BASED ALLOYS AND APPARATUS FOR CARRYING OUT SAME

BACKGROUND OF THE INVENTION

1. Field of The Invention

This invention relates generally to the electrometallurgical melting of titanium and titanium-based alloys. In particular, it relates to the electroslag of titanium and titanium-based alloys, and more specifically to magnetically-controllable, electroslag melting of these metals.

This invention may find application in the production of titanium, and particularly low alloyed titanium-based alloys, characterized by a high density of cast metal, absence of gas pores and inclusions, and low contents of admixtures, thereby allowing application of the above materials in aviation and shipbuilding industries, power generation, chemistry, nuclear power sector and manufacture of home appliances.

2. Description of the Prior Art

Methods of electron beam and induction melting of titanium and its alloys, have been described in E. L. Morozov et al., "Investigation of Various Methods of Melting and Casting of Titanium Alloys", TMS/AIME, P.O. Box 430,420 Commonwealth Dr., Warrendale, Pa., 15086, 1980; D. J. Chronister, S. W. Scott. D. R. Stickle, D. Eylon, F. H. Froes, "Induction of Skull Melting of Titanium and Other Reactive Alloys", *Journal of Metals*, September 1986, pp. 51–54.

Common drawbacks of metals produced by these methods include low density and the presence of gas pores, cavities, and inclusions. Serious drawbacks exist in the chemical and physical heterogeneity caused by the low hydrodynamic activity of metallurgical melt in the course of crystallization.

A well-known and widely used commercial method of melting titanium and its alloys is the vacuum arc melting (VAM) method which is disclosed in U.S. Pat. No. 5,127,468. This technology is over fifty years old, and resources for improving the quality of the metal produced by this technology have been exhausted. Metals produced by this method are characterized by the presence of gas pores and inclusions, as well as a nonuniform distribution of alloying elements and admixtures. Arc burning and passage of an electric current through the metallurgical pool result in a certain hydrodynamic activity of the melt, which is higher than in cases of electron beam and induction melting. However, the flows existing in the metal pool have an unfavorable orientation, thereby making it deeper in the central area. As a result, an area of loose metal featuring concentration of gas pores and inclusions is formed in the axial portion of an ingot.

Electroslag processes possess extensive, but as yet unused, possibilities of producing chemically and physically homogeneous metal (see e.g. "Avtomaticheskaya Svarka", No.10, 1963, pp. 37–42, published by the Ukrainian SSR Academy of Sciences, Kiev and U.S. Pat. No. 3,989,091). In the melting oftitanium and its alloys, the known electroslag melting technology does not take into account the effect of magnetohydrodynamic processes inside slag and metal pools on crystallization of metal.

In contrast to other known technologies of electric melting of titanium and its alloys, melting with the use of electroslag processes involve the presence of a slag pool above the metal one. The presence of the slag pool featuring a high density of electric current has a wide range of hydrodynamic effects on metal crystallization. These effects may be both positive and negative. In the well-known processes of electroslag refining (ESR), the hydrodynamics of the slag pool (intense) and metal pool (less intense) is governed by electromagnetic forces arising from the interaction between the melting current, $I_m$, and the proper magnetic field. The size of the electrode gap and melting current, $I_m$, along with its value, density, and passage path in slag and metal melts constitute major reasons for the motion of a current-carrying fluid. In the above-mentioned studies, the electric current, which had been decreasing in the course of melting, was stabilized through the variation of the electrode feed rate.

The known electroslag melting processes do not include any mechanisms for stabilizing the crystal structure and ingot quality over its whole height through stabilization of the hydrodynamic situation in slag and metal melts. Permanent variations of hydrodynamics in the course of the melting process are caused by naturally decreasing the melting current, $I_m$, as the electrode is melted. A decrease in the voltage drop across the electrode, $U_e$, which is not registered in the course of melting, automatically increases the voltage drop across the slag pool, $U_s$: $U_m=U_e+U_s=\text{const}$.

Since in the known electroslag processes of titanium melting the value of $U_m$ is constant (it is picked up from terminals of the power supply secondary winding and is measured either on these terminals or on current leads of electrode and crystallizer), the value of $U_s$, which is permanently increasing in the course of melting, results in a smooth decrease of $I_m$. Here, current passage path and current density are changed as a result of the increase in the electrode gap. The only known method of stabilizing the value of $I_m$, other than by the size of the electrode gap, consists of increasing the rate of electrode feed into the pool. The stabilization of the current value however, as in the case of the constant electrode feed rate, is accompanied by an increase in the electrode gap. As the voltage drops across the slag pool, $U_s$ increases. In so doing, the melting process is accompanied by permanent changes in the melting current path within the electrode gap, the corresponding magnetic field, and the bulk electromagnetic forces, causing toroidal motion of the melt. Therefore, in order to avoid violating the electroslag process at the end of melting by electrode withdrawal from the slag pool and arc burning at the slag surface, the initial stage of melting is carried out at a minimal sized electrode gap. From the standpoint of hydrodynamics, these are the most unfavorable conditions of ingot crystallization because of formation along the ingot axis of an area of low-quality, loose metal containing gas pores and inclusions. In addition, the initial stage of melting is characterized by nonuniform distribution of alloying elements and admixtures in the metal. Electrode end face lift to the slag pool surface results in the increase of slag pool involvement in the toroidal motion of the melt, increase in metal homogeneity, and elimination of the low-quality metal area along the ingot axis. The Most favorable conditions for ingot crystallization are created by a stable electroslag melting of the electrode next to the slag pool surface.

The prior art melting processes do not permit the stabilization of the electrode melting mode in the upper layers of the pool with a constant electrode gap. As the electrode "exits" to the slag pool surface an unstable electric arc occurs at the slag pool surface, accompanied by sputtering (slopping) of slag and inadmissible low quality of ingot formation.

SUMMARY OF THE INVENTION

The instant invention provides methods and devices for the magnetically-controllable, electroslag melting of titanium and titanium-based alloys wherein, due to the stabilization of conditions ensuring uniform flow distribution of a current-carrying fluid in a melt, there is provided a substantially homogeneous hydrodynamic structure of a melt over substantially the whole length of an ingot to be melted, thereby resulting in a substantially homogeneous ingot.

The devices and methods of the invention provide a uniform flow distribution of a current-carrying fluid by maintaining substantially constant levels of melting current, feed rate of consumable electrode, and electrode gap size.

With the invention, a user can select a ratio between the process parameters wherein electrode melting would take place in the upper portion of a slag pool with a maximum admissible value of the electrode gap. Also, the devices and methods of the invention provide a stable melting current and an electrode gap at a constant feed rate of a consumable electrode by smoothly decreasing the melting voltage. The invention further provides an optimum range of gauge pressures, thereby providing an additional mechanism by which to control the hydrodynamic situation in the process of crystallization. The devices and methods of the invention also provide a preferred flux composition possessing a high refining ability under conditions of selected pressure values. Finally, the invention provides a means for stabilization and smooth monitoring of the melting voltage.

The objects of the invention are achieved by providing a method of magnetically-controllable, electroslag melting comprising the steps of:

- providing an electrical contact between a consumable electrode and a crystallizer filled with an amount of a flux;
- evacuating a crystallizer area and developing a controllable pressure of inert gas therein;
- passing an electric current through the electrode, causing the melting of the flux and the consumable electrode and resulting in the production of a melt of slag pool and metal pool;
- stabilizing the conditions for uniform flow distribution of a current-carrying fluid, resulting in a substantially uniform hydrodynamic structure over substantially the total length of an ingot to be melted;
- crystallizing a metal ingot at the interface of said metal pool and said slag pool at a substantially constant rate, as said metal pool is replenished through melting of the consumable electrode; and
- withdrawing the ingot from said crystallizer.

Stabilization of conditions for uniform flow distribution of the current-carrier fluid is carried out by maintaining, in the course of melting, preset values of melting current, electrode feed rate, and electrode gap size.

Here, it is preferable to select such melting current and electrode feed rate values that would provide electrode melting in the upper portion of a slag pool with a maximum admissible size of the electrode gap. Furthermore, the melting current is maintained substantially constant and the electrode gap is maintained at a substantially constant feed rate of a consumable electrode by smoothly decreasing the melting voltage. The consumable electrode preferably comprises a material selected from the group consisting of spongy titanium, spongy titanium with alloying additives, titanium, and titanium-based alloys.

The above process should be carried out under a gauge pressure of from about $1.1\times10^5$ to about $3.6\times10^5$ Pa, and preferably from about $1.4\times10^5$ to about $2.0\times10^5$ Pa.

Under a pressure of from about $1.1\times10^5$ to about $2.0\times10^5$ Pa, the preferred flux composition is a $CaF_2$-$CaCl_2$ composition.

Under a pressure of from about $2.0\times10^5$ to about $3.6\times10^5$ Pa, the preferred flux composition is a $CaF_2$-KCl composition.

Under a pressure of from about $1.4\times10^5$ to about $2.0\times10^5$ Pa, the preferred flux composition is a $BaF_2$-$CaCl_2$ composition.

The objects of the invention are also achieved by providing an apparatus for magnetically-controllable, electroslag melting of titanium and titanium-based alloys, comprising:

- a crystallizer provided with an internal volume forming a melting area partially filled with a metered amount of flux;
- a vacuum chamber interfacing with the crystallizer melting area;
- means for supplying the crystallizer with an inert gas for developing gauge pressure therein;
- means for positioning the consumable electrode inside said melting area and in electrical contact with said crystallizer;
- a power supply providing current passage through the consumable electrode and the flux, and subsequent formation of a slag pool and metal pool as the electrode is melted;
- means for stabilizing the melting current, by providing substantially constant values of melting current and an electrode gap with a substantially constant feed rate of said electrode into said melting area, to produce a uniform hydrodynamic structure over the total length of an ingot being melted; and
- means for carrying out relative shift of an ingot being melted and said crystallizer in the course of crystallization, and for removing a resulting ingot from said crystallizer.

The power supply is preferably is connected to a transformer, and the means for stabilization is preferably provided with a thyristor controller and a control device, connected into a circuit of primary winding of the transformer.

BRIEF DESCRIPTION OF THE DRAWINGS

These and other objects and advantages of the invention will become obvious from the following description of specific embodiments thereof with reference to accompanying drawings, in which.

PREFERRED EMBODIMENT OF THE INVENTION

Figure 1:
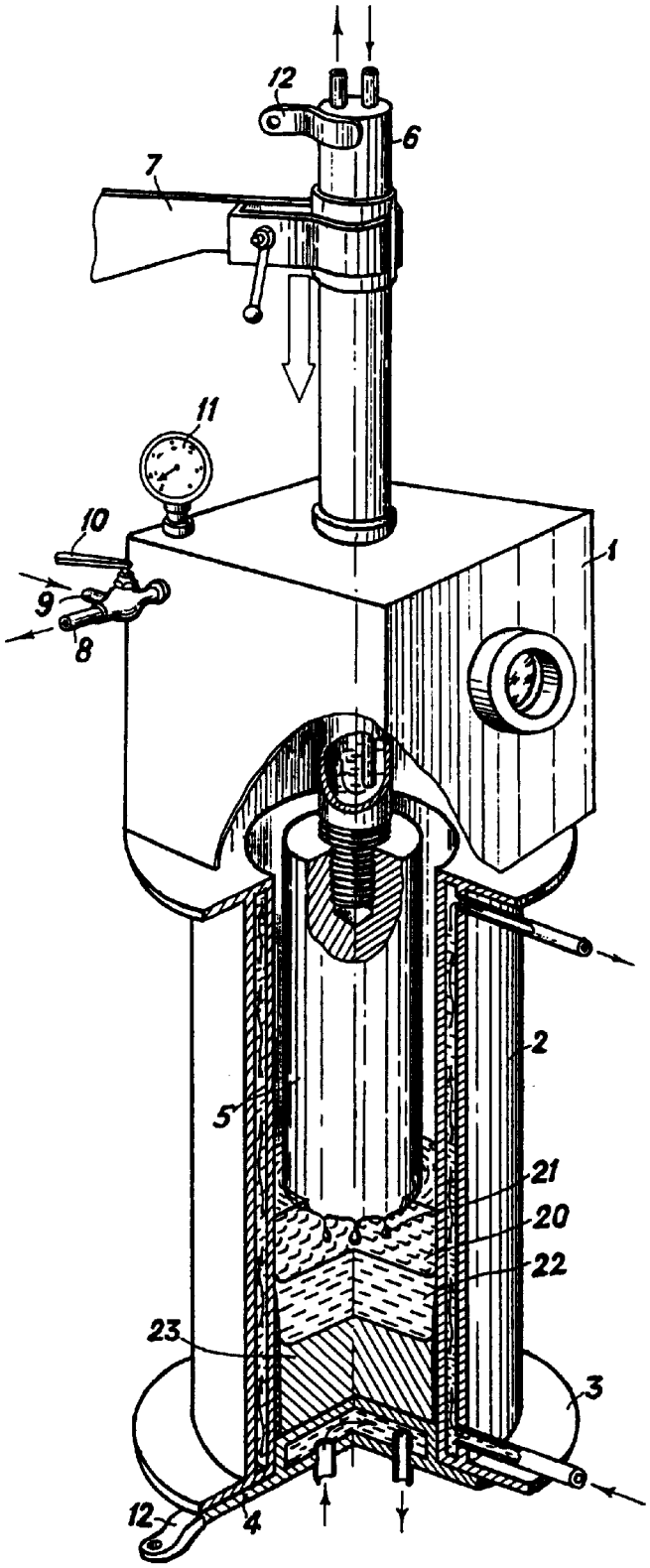
FIG. 1 is a plan view of the apparatus for magnetically-controllable, electroslag melting of titanium and titanium-based alloys, intended for carrying out the method of the invention.

The method of the invention is best implemented on the apparatus shown in FIG. 1. This apparatus comprises a vacuum chamber 1 which is hermetically connected to a water-cooled crystallizer 2 generally made of copper. A tray 3 of crystallizer 2 is sealed by means of a vacuum seal on a flange 4. The apparatus is provided with a consumable electrode 5 made for shifting relative to the crystallizer 2. In embodiments of the invention, electrode 5 may be made of compacted spongy titanium or spongy titanium containing alloying elements. In the course of repeated melting, the consumable electrode comprises welded together ingots of the first or any subsequent melting. The upper portion of the consumable electrode 5 is connected to a current-carrying rod 6 which is fixed in a device 7 for shifting electrode 5.

A connecting pipe 8 is used for evacuating air from chamber 1, preferably down to a pressure of $10^{-2}$ to $10^{-5}$atm. Another connecting pipe 9 of chamber 1 is used to fill chamber 1 with an inert gas. Control of the passage of air and inert gas is carried out by valve 10. A pressure gauge 11 mounted on chamber 1 is intended for measuring the pressure of inert gas inside chamber 1.

Figure 2:
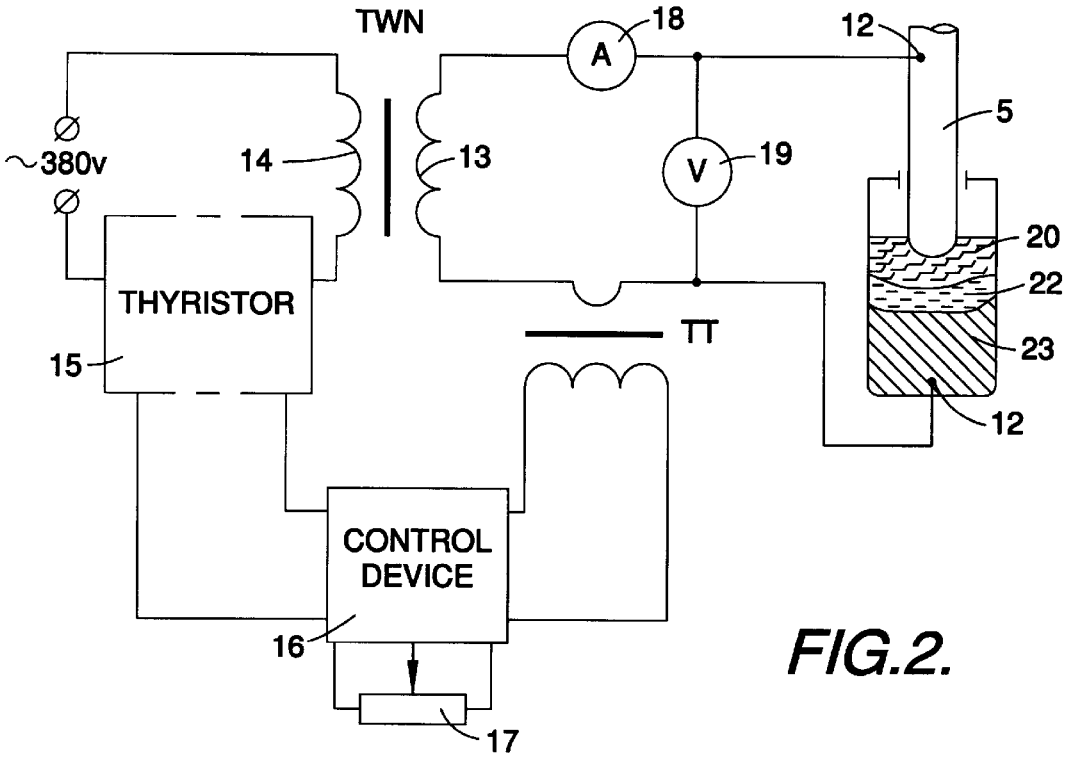
FIG. 2 is the electrical diagram of the power supply comprising stabilization means of the invention.

Electric voltage is supplied to consumable electrode 5 and crystallizer 2 via current leads 12 from a transformer connected to a power source. The power transformer may be an AC transformer with a current rating of 10, 15, or 20 kA and an open-circuit voltage of 20 to 50 V. The proposed embodiment of the invention may use the power transformer shown in FIG. 2. Secondary winding 13 of such transformer is connected via current leads 12 to the tray 3 of the crystallizer 2, current-carrying rod 6, and consumable electrode 5.

According to the invention, a thyristor unit 15 is mounted in the primary winding circuit 14 of the transformer; this unit, together with a control unit 16, provides smooth control of the melting voltage. In the open position of a switch 17, manual control of the voltage is provided in the course of electrode melting in order to maintain the preset level of melting current which is measured by an ammeter 18. The melting voltage is measured by a voltmeter 19.

The automatic stabilization mode may be implemented with the use of any traditional facilities for automatically tracking current deviations from a preset value and sending control signals that ensure a corresponding compensation of melting current decrease and variation of the electrode gap through a smooth decrease of the melting voltage.

In the processes of the invention, consumable electrode 5 is inserted through crystallizer 2 and gas chamber 1, and put into short-circuit with tray 3 of crystallizer 2, following which tray 3 is covered with a powdered flux, preferably comprising about 80% mass $CaF_2$ and 20 mass% $CaCl_2$. Tray 3 is sealed with crystallizer 2 by means of the vacuum seal of flange 4. The upper portion of consumable electrode 5 is fastened to current-carrying rod 6 fixed in electrode shifting device 7.

The air is evacuated from chamber 1 through connecting pipe 8 to provide a vacuum of about $10^{-2}$ to $10^{-3}$ atm. Chamber 1 is filled with an inert gas through connecting pipe 9. Argon is a preferred inert gas. Connecting pipes 8 and 9 are opened and closed by valve 10.

In a preferred embodiment of the invention, the inert gas pressure inside chamber 1 is brought to about $1.1\times10^5$ to $3.6\times10^5$ Pa. Selection of the lower value is caused by the possibility of utilizing fluxes having increased boiling points, while the upper value is caused by technical complexities of process implementation. Here, the most preferred range of pressure is from about $1.4\times10^5$ to about $2.0\times10^5$ Pa. Electric voltage to current leads 12 is supplied from the power transformer shown in FIG. 2. The melting voltage is measured by voltmeter 19. An electric arc is ignited on tray 3, after which electrode 5 begins to decent. The electric arc melts electrode 5 and the granulated flux, and a slag pool 20 is formed.

The arc process changes to an arcless electroslag one. Electrode metal drops 21, passing through slag pool 20, form a metal pool 22 under slag pool 20. The electric voltage of melting is set (preferably at the level of $U_m$=20–22 V), and the feed rate of electrode 5 is set (preferably at $V_e$=1–4 m/hr) thereby providing a preset value of the melting current, $I_m$=20 kA, recorded by ammeter 18. Process parameters of the metal pool are achieved. Electrical resistance of the slag pool, $R_s$, is much higher than the electrical resistance of other elements of the melting circuit. The former resistance governs the amount of heat released inside the slag pool and consumed by electrode melting and formation of an ingot 23:

$$Q_s=0.24\ U_sI_m=0.24\ I_m^2R_s.$$

Electrical resistance of consumable electrodes 5 made of titanium, and particularly those made of spongy titanium, is several times higher than that of electrodes made of iron, copper, and aluminum alloys. Correspondingly, the voltage drop in the spongy titanium electrode will be higher. In other words, basic constituents of the melting voltage, $U_m$, will comprise the drop of voltage, $U_s$, across the slag pool and the drop of voltage, $U_e$, across the consumable electrode:

$$U_m=U_s+U_e.$$

The heat released in the electrode and slag pool during the passage of melting current, $I_m$, will be:

$$Q=0.24U_mI_m=0.24\ I_m^2(R_s+R_e)$$

$$Q_e=0.24\ I_m^2R_e.$$

Figure 3:
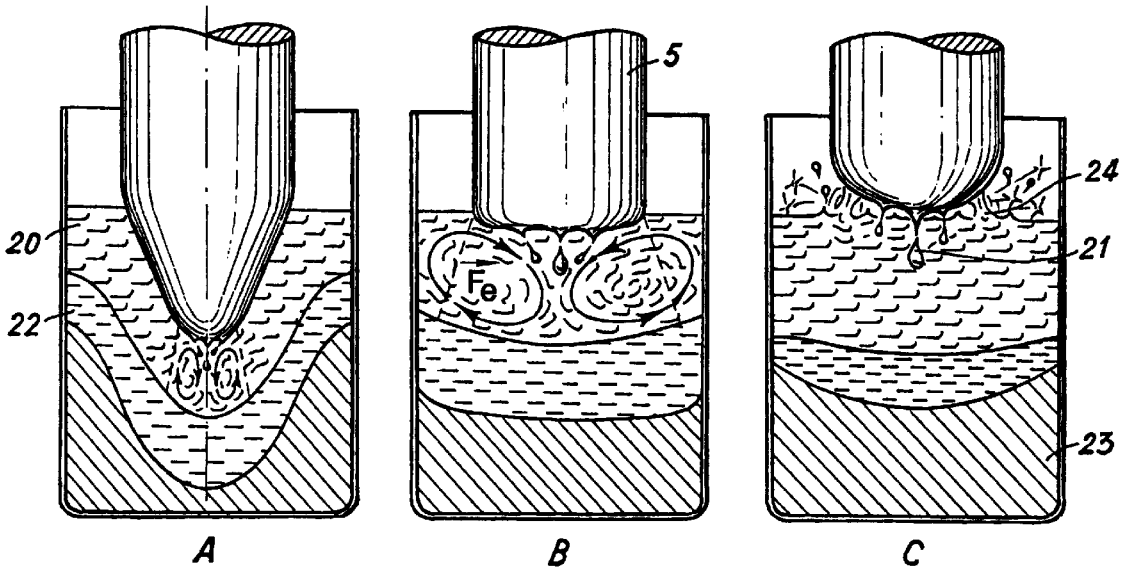
FIGS. 3(A,B,C) is the schematic drawing of magnetohydrodynamic flows versus electrode gap size.

At first, electrode 5 is melted at the surface of metal pool 22 as shown in FIG. 3A. Without stabilization of the optimal conditions of ingot crystallization, proposed according to the invention, a crater and correspondingly a recess in the metal pool 22 are created in the metal beneath the electrode because of the local toroidal rotation of slag. This fact results in an unfavorable radial growth of crystallites. A recess in the axial portion of metal pool 22 is also promoted by the ingress of overheated metal of electrode drops 21.

The fraction of heat released in electrode 5, $Q_e=0.24\ I_m^2R_e$, is high. As electrode 5 is melted, this fraction will decrease pro rata the decrease in its resistance, $R_e$. Here, melting voltage, $U_m$, rigidly preset by the transformer, will be redistributed towards increase in the voltage drop, $U_s$, across slag pool 20. As the temperature of pool 20 increases, electrode 5 melts faster, its end melting face may go up to the upper layers of slag; the resistance of the electrode gap in slag pool 20 increases, and the melting current, $I_m$, considerably decreases (FIG. 3B). Melting of electrode 5 having a high electrical resistance will inevitably cause substantial modification to electroslag process parameters and hence to the quality of ingot 23, In this case, the structure and quality of ingot 23 will continuously change from the bottom and up to the top portion thereof.

To ensure uniform quality over the whole length of ingot 23, according to the invention, the conditions of homogeneous flow distribution of the current-carrying fluid within the volume of slag pool 20 is stabilized by maintaining substantially constant the values of important process parameters such as the current value, the electrode feed rate, the depth of its immersion, and the electrode gap. It has been found that these parameters govern the invariability of value and paths of current inside the current-carrying pool. It has been also found that the most stable mode of welding is that mode in which electrode 5 melts in the upper portion of slag pool 20 at a substantially constant, maximum permissible electrode gap (FIG. 3B). In this mode, magnetohydrodynamic toroidal motion uniformly encompasses the major portion of the slag pool, the depth of metal pool 22 substantially evens out, and orientation of crystallites becomes close to axial. In addition, the conditions of metal pool 22 refinement from admixtures and inclusions, concentrated at the end faces of growing crystallites, also become favorable. Without maintaining the above parameters substantially constant, further increase in the electrode gap results in a decrease in the stability of the electroslag melting process (FIG. 3C). The electrode is melted in the arc-slag mode accompanied by unstable arc burning, ejection of slag 24, and sharp deterioration of metal quality. Thus, the proposed method stabilizes the melting of electrode 5 at the surface of slag pool 20 at a maximum permissible electrode gap.

According to the invention, stabilization of the melting current may be accomplished by controlling the melting voltage supplied from the transformer to the melting circuit with the use of the thyristor controller 15 (FIG. 3) and control device 16 in the primary winding 14 of the transformer.

The need to strictly monitor and maintain the preset value of current, $I_m$, passing through the slag and metal pools is governed by the need to provide and maintain, in the course of the total melting process, the same hydrodynamic structure of melt. To ensure permanent direction and intensity of motion (flow) of the melt during the whole melting process, it is necessary to maintain constant direction and value of the melting current, $I_m$, and induction of the proper magnetic field B, which are directly responsible for the direction and value of bulk electromagnetic forces governing hydrodynamic structures of the slag and metal pools:

$$\overrightarrow{F_e=I_m\times B}.$$

The invariable nature (pattern, intensity) of motion in slag pool 20 and metal pool 22 provides a basis for stable and uniform quality of metal over substantially the whole length of ingot 23.

According to the inventive method, in the course of stabilization of hydrodynamic conditions it is possible to take into consideration the permanent effect on slag pool 20, melting stability, and namely on the gauge pressure developed in chamber 1.

Variation of gas gauge pressure in the melting area within the scope of used fluoride-chloride flux systems permits expanded temperature and process boundaries of the stable electroslag process, thereby improving stabilization conditions for optimum melting modes.

In the course of MEM process, the use is made of a controlled inert gas atmosphere at an absolute pressure of from about $1.1\times10^5$ to about $3.6\times10^5$ Pa. During the melting process, an increase in the gas pressure provides attainment of the following two goals:

1. Increases the boiling points of fluoride-chloride fluxes up to values exceeding the upper limit of slag pool temperatures.
2. Increases the pressure applied to the metal being crystallized. This results in consolidation of intercrystalline boundaries, and increase in metal plasticity and impact toughness.

In the magnetically-controllable, electroslag melting methods and apparatuses of the invention, metal refining from harmful admixtures may be accomplished mainly through the use of fluoride-chloride fluxes. Among a number of fluoride-chloride fluxes, the most refractory is the flux consisting of about 93% mass $CaF_2$ and about 7% mass $BaCl_2$. The most fusible is the flux consisting of about 58% mass $BaF_2$ and about 42% mass KCl.

According to one aspect of the invention, to ensure stable progress of the electroslag process with the use of a refractory flux, a minimum gas pressure of about $1.1\times10^5$ Pa would be sufficient. In the case of a fusible flux, a minimum gas pressure of about $3.6\times10^5$ Pa is preferred.

The most preferred gas pressure range recommended for carrying out the processes of the invention is from about $1.4\times10^5$ to about $2.0\times10^5$ Pa. Within this pressure range, utilization of fluxes based on alkali-earth metals is preferred. Thus, a flux consisting of about 91% mass $CaF_2$ and about 7% mass $MgCl_2$ is one suitable flux composition.

EXAMPLES

Given below are specific Examples of embodiments of the inventive method and comparative characteristics of the quality of melted ingots. Here, Examples 1 through 3 are given for the purpose of quality assessment with various depths of electrode melting. Examples 4 and 5 provide embodiments with and without stabilization of the melting mode. Example 6 demonstrates the effect of gauge pressure on the metal quality.

The electrodes subjected to melting were made of spongy titanium, spongy titanium alloyed with aluminum, and spongy titanium alloyed with aluminum and vanadium. One hundred (100) mm diameter electrodes were melted to produce 160 mm diameter ingots of commercial grade titanium, Ti-3Al and Ti-6Al-4V alloys. The above metal ingots were once again melted to produce 250 mm diameter ingots of commercial grade titanium, Ti-3A1 and Ti-6Al-4V alloys.

Melting of electrodes was carried out in 5 modes.

Mode 1. Slag-arc melting at the metal pool surface.

Mode 2. Electroslag melting with maximum electrode immersion.

Mode 3. Electroslag melting with medium electrode immersion.

Mode 4. Electroslag melting with minimum electrode immersion.

Mode 5. Slag-arc melting at the slag pool surface.

Values of melting parameters for ingots of commercial-grade titanium, Ti-3Al and Ti-6Al-4V alloys, given in Table 1, are the same.

The voltage drop across the slag pool during 100 mm diameter electrode melting was $U_s$=21 V, and for 160 mm diameter electrode was $U_s$=24 V. The depth of electrode immersion into slag was adjusted by means of its feed rate, as shown in Table 1. In Mode 1, electrode melting was accompanied by unstable slag-arc process on the metal pool surface. An oscillogram of the melting current indicated arc breakdowns of amplitude values of the current sinusoid. In Mode 2, the electrode was melted at the minimum allowable distance from the metal pool surface, thereby resulting in a stable electroslag process. In this case, an oscillogram of the melting current comprised a regular sinusoid that characterizes an arc-free electroslag process. In Mode 3, the electrode was melted within medium layers of the metal pool, its feed rate being lower than in Modes 1 and 2. In Mode 4, electrode was melted at a minimum depth of immersion into slag, thereby resulting in a stable electroslag process. In Mode 5, the electrode feed rate was reduced (see Table 1) down to minimum values for melting processes under investigation wherein a slag-arc process takes place on the slag pool surface. This process was accompanied by unstable arc burning, slag ejection, and breakdowns in amplitude values of the melting current sinusoid.

TABLE 1

| Item No. | Melting mode | Ingot diameter, mm | Slag pool depth, mm | Electrode immersion depth, mm | Electrode feed rate, m/hr | Melting current, A |
|---|---|---|---|---|---|---|
| 1 | 1 | 160 | 40 | 38 | 3.5 | 8300 |
| 2 | 2 | | 36 | 3.3 | | |
| 3 | 3 | | 20 | 2.7 | | |
| 4 | 4 | | 5 | 2.1 | | |
| 5 | 5 | | 0–4 | 1.9 | | |
| 6 | 1 | 250 | 60 | 57 | 2.9 | 12600 |
| 7 | 2 | | 55 | 2.7 | | |
| 8 | 3 | | 30 | 2.2 | | |
| 9 | 4 | | 6 | 1.7 | | |
| 10 | 5 | | 0–5 | 1.7 | | |

EXAMPLE 1

Ten (10) ingots of commercial grade titanium were produced, 5 ingots in the first melting, 160 mm in diameter, and 5 ingots in the second melting, 250 mm in diameter. In the first melting, the diameter of the spongy electrode was 100 mm, while in the second melting the electrodes were 160 mm diameter commercial grade titanium ingots produced in the course of the first melting. Maintenance of the preset melting current (see Table 1) was accomplished by varying the electrode feed rate. As shown in Table 2, the metal of the first and second melting, produced in Modes 1 and 5, was characterized by unsatisfactory ingot formation and the presence of gas pores and slag inclusions in the ingot axial portion. An unstable slag-arc process does not permit refinement of the metal by means of slag to remove hazardous atmospheric gases. Above all, this fact negatively affects metal plasticity and impact toughness. Stable electroslag processes with deep electrode melting in case of Mode 2 is characterized by intense toroidal rotation of a small amount of melt under the electrode.

TABLE 2

| Item No. | Melting mode | Ingot diameter, mm | Composition, mass % | | | Mechanical properties | | | Ingot formation | Gas pores | Slag inclusions |
|---|---|---|---|---|---|---|---|---|---|---|---|
| | | | oxygen | nitrogen | hydrogen | elongation, % | reduction of area, % | Impact toughness, J/cm$^2$ | | | |
| 1 | 1 | 160 | 0.15 | 0.055 | 0.006 | 11.5 | 23.4 | 123 | poor | yes | yes |
| 2 | 2 | | 0.14 | 0.050 | 0.005 | 18.1 | 49.8 | 204 | fair | yes | no |
| 3 | 3 | | 0.13 | 0.045 | 0.004 | 22.8 | 62.6 | 236 | good | no | no |
| 4 | 4 | | 0.12 | 0.040 | 0.004 | 28.7 | 74.2 | 290 | excellent | no | no |
| 5 | 5 | | 0.14 | 0.050 | 0.005 | 16.8 | 31.5 | 152 | poor | no | yes |
| 6 | 1 | 250 | 0.15 | 0.053 | 0.006 | 12.9 | 25.3 | 138 | poor | yes | yes |
| 7 | 2 | | 0.14 | 0.047 | 0.004 | 19.6 | 51.1 | 207 | fair | yes | no |
| 8 | 3 | | 0.12 | 0.040 | 0.004 | 23.5 | 59.1 | 249 | good | no | no |
| 9 | 4 | | 0.11 | 0.030 | 0.004 | 30.2 | 78.5 | 310 | excellent | no | no |
| 10 | 5 | | 0.14 | 0.045 | 0.005 | 14.5 | 27.3 | 141 | poor | no | yes |

Such a local motion negatively affects the metal pool shape through creating a significant recess in the axial portion thereof. In turn, such recess deteriorates the conditions of metal crystallization and promotes the formation of gas pores in the above axial portion. At the same time, a stable melting process even in this case promotes certain refining of metal and ingot formation improvement. Metal plasticity and impact toughness correspondingly increase. In the case of melting according to Mode 3, stable electrode melting within medium metal layers is accompanied by an expansion of the region of melt toroidal motion. This fact favorably affects the process of ingot formation, refining and crystallization of metal, improvement of its plasticity and impact toughness, and complete removal of gas pores and slag inclusions.

A higher quality level of an ingot made of commercial grade titanium is achieved in case of a maximum electrode gap (i.e. with a stable electroslag melting of electrode in Mode 4) at the slag pool surface. Here, the whole pool is in motion, and the hydrodynamic pressure is uniformly distributed over the metal pool surface and a substantially flat bottom of the metal pool is formed. In this case hydrodynamics permitted maximum intensification of metal refining from gases, thereby providing its highest plasticity and impact toughness, combined with excellent formation of the ingot surface.

EXAMPLE 2

Ten (10) ingots of Ti-3Al titanium α-alloy were produced, using Modes 1 through 5 from Table 1, and both first and second melting procedures. Results of studies of ingots quality are given in Table 3. The ratio between quality of ingots produced by various melting methods is the same as for commercial grade titanium ingots whose characteristics are given in Table 2. In addition, Table 3 sets forth the results of studies of Al contents in the bottom, medium and top portions of ingots. The above portions were used for making metal specimens intended for impact toughness tests. An increase in the homogeneous distribution of Al in the ingot metal and growth of impact toughness parameters from Mode 1 and up to Mode 4 can be traced. In case of Mode 5 melting, both Al distribution uniformity and metal impact toughness deteriorated.

Electrode melting with the minimum immersion into slag in the course of melting Ti-3Al alloy in Mode 4 provides higher values of homogeneity, impact toughness and ingot formation, as well as absence of any defects as against other melting modes.

TABLE 3

| Item | Melting | diameter, | Aluminum, mass % | | | Impact toughness, J/cm$^2$ | | | Ingot | Gas | Slag |
|---|---|---|---|---|---|---|---|---|---|---|---|
| No. | mode | mm | Bottom | Middle | Top | Bottom | Middle | Top | formation | pores | inclusions |
| 1 | 1 | 160 | 2.7 | 3.5 | 2.2 | 67 | 53 | 94 | poor | yes | yes |
| 2 | 2 | | 3.3 | 2.8 | 3.1 | 92 | 109 | 103 | fair | yes | no |
| 3 | 3 | | 3.2 | 2.9 | 3.3 | 110 | 116 | 91 | good | no | no |
| 4 | 4 | | 3.0 | 3.0 | 2.9 | 113 | 116 | 121 | excellent | no | no |
| 5 | 5 | | 2.3 | 2.8 | 3.4 | 72 | 79 | 51 | poor | no | yes |
| 6 | 1 | 250 | 2.5 | 2.1 | 3.6 | 61 | 76 | 49 | poor | yes | yes |
| 7 | 2 | | 3.2 | 2.8 | 3.3 | 89 | 94 | 73 | fair | yes | no |
| 8 | 3 | | 3.3 | 3.2 | 2.9 | 114 | 119 | 121 | good | no | no |
| 9 | 4 | | 3.0 | 3.0 | 3.0 | 129 | 134 | 132 | excellent | no | no |
| 10 | 5 | | 2.0 | 3.8 | 3.1 | 73 | 36 | 85 | poor | no | yes |

EXAMPLE 3

As in Example 2, 10 ingots of Ti-6Al-4V alloy were produced.

Al and V distribution, as well as metal impact toughness in the central and peripheral portion of ingots were studied. Results of these studies are given in Table 4. Due to the uniform motion of the melt over the whole pool volume in the case of Mode 4 melting, Al and V were uniformly distributed both in central and peripheral portions of ingots. Correspondingly, the highest and most uniform values of impact toughness in the central and peripheral portions of ingots will be available in this case. Levels of homogeneity and quality of the Ti-6Al-4V alloy produced in compliance with Modes 1 through 5 vary similarly to the quality of commercial grade Ti and Ti-3Al alloy produced in the same modes.

TABLE 4

| Item | Melting | Ingot diameter, | Composition, mass % | | | | Impact toughness, J/cm$^2$ | |
|---|---|---|---|---|---|---|---|---|
| | | | Al | | V | | | |
| No. | Mode | mm | center | periphery | center | periphery | center | periphery |
| 1 | 1 | 160 | 4.8 | 7.1 | 5.1 | 2.9 | 40 | 52 |
| 2 | 2 | | 5.0 | 6.6 | 4.5 | 3.4 | 61 | 76 |
| 3 | 3 | | 5.7 | 6.3 | 4.2 | 3.7 | 81 | 85 |
| 4 | 4 | | 5.9 | 6.0 | 4.1 | 3.9 | 95 | 96 |
| 5 | 5 | | 3.5 | 2.8 | 4.7 | 3.1 | 32 | 39 |
| 6 | 1 | 250 | 4.7 | 6.9 | 4.6 | 3.3 | 39 | 48 |
| 7 | 2 | | 5.4 | 6.3 | 4.2 | 3.7 | 63 | 79 |
| 8 | 3 | | 5.8 | 6.2 | 4.1 | 3.8 | 82 | 83 |
| 9 | 4 | | 6.0 | 6.0 | 4.0 | 3.9 | 98 | 97 |
| 10 | 5 | | 2.6 | 3.1 | 3.8 | 2.5 | 28 | 33 |

Examples 4 and 5 below analyzed comparative quality characteristics of a metal melted in compliance with the prior art technology (i.e., without stabilization of the optimum melting conditions—Mode 1), and in compliance with the methods of the invention (i.e. with stabilization of electrode melting at the slag pool surface—Mode 2). The above Modes are characterized by the following:

Mode 1—The melting current was stabilized by increasing the electrode feed rate. In the course of melting in Mode I, the melting current and voltage were constant, while the electrode gap is increased, resulting in elongation of current lines. The magnetic field of the melting current was variable.

Mode 2—The melting current was stabilized by decreasing the melting voltage, with the electrode feed rate being constant (the inventive method). In the inventive method, the current and electrode gap, as well as the length of current lines were substantially constant due to the constant value of voltage drop across slag pool, $U_s$, which was stabilized by reducing the melting voltage supplied from the transformer secondary winding.

Table 5 sets forth the melting conditions for commercial-grade Ti, Ti-3Al and Ti-6Al-4V alloys in Modes 1 and 2. The same diameter ingots (160 and 250 mm) were produced with the use of the same electrodes as described in Examples 1 through 3.

TABLE 5

| Item No. | Melting mode | Ingot diameter, mm | Melting voltage, V top | middle | bottom | Melting current, A | Metal |
|---|---|---|---|---|---|---|---|
| 1 | 1-1 | 160 | | 29 | | 8300 | commercial grade Ti |
| 2 | 2-1 | | 31 | 29 | 27 | | |
| 3 | 1-2 | 250 | | 26 | | 12300 | |
| 4 | 2-2 | | 28 | 26.5 | 25 | | |
| 5 | 1-3 | 160 | | 29.5 | | 8700 | |
| 6 | 2-3 | | 32 | 29.5 | 27 | | Ti-3Al |
| 7 | 1-4 | 250 | | 27 | | 12800 | |
| 8 | 2-4 | | 29 | 27 | 25 | | |
| 9 | 1-5 | 160 | | 30 | | 8900 | |
| 10 | 2-5 | | 34 | 30 | 26 | | Ti-6Al-4V |
| 11 | 1-6 | 250 | | 30 | | 13100 | |
| 12 | 2-6 | | 32.5 | 30 | 27.5 | | |

By using Mode 1, it was possible to melt ingots of a required length since the growth of the electrode gap caused by electrode melting was compensated by increasing electrode feed rate. This compensation however is incomplete because of the buildup of voltage drop across the pool which resulted in an increase in the electrode gap at a constant value of melting current.

Mode 2 was used for melting ingots of a required length at a substantially constant value of melting current and its stable paths, within a substantially constant electrode gap. No other methods of melting current stabilization in terms of its value or paths within the slag pool are known. The inventive methods constitute the only way to ensure homogeneity and high quality over substantially the total ingot length. Continuous melting of the electrode at the slag pool surface creates the best conditions for magnetohydrodynamic activation of flux-induced metal refinement from gas admixtures, thereby increasing metal plasticity and impact toughness, and improving ingot crystallization.

Examples 5 and 6 below demonstrate the differences in the uniformity ofquality of commercial-grade Ti, Ti-3Al and Ti-6Al-4V alloys over the ingot length using melting Modes 1 and 2.

EXAMPLE 4

Modes 1-1, 2-1, 1-2, and 2—2, given in Table 5, were used to melt 160 and 250 mm diameter ingots of commercial-grade Ti. It can be seen from the data given in Table 6 that the contents of gas admixtures in the commercial-grade Ti (in the case of stabilization of electrode melting at the slag pool surface, i.e., modes 2-1 and 2—2) were substantially homogeneous over the total ingot length and represented by minimum amounts. There is no actual difference between gas contents in the bottom, medium, and top portions of the ingot. Titanium produced with the use of traditional modes 1—1 and 2—2, comprises higher amounts of gas admixtures in the medium and particularly in the bottom portions of ingots. Similarly, the highest values of Ti plasticity and impact toughness was stabilized over the ingot length in cases where stabilization of electrode melting at the slag pool surface was provided (modes 2-1 and 2—2). Melting of ingots in the prior art modes (1-1 and 1-2) is accompanied by metal crystallization with nonuniform values of plasticity and impact toughness in the bottom, medium, and top portions of the ingot.

EXAMPLE 5

In the ingots made of Ti-3Al and Ti-6Al-4V alloys, both uniform distribution of gases in the metal and contents of such gases are similar to the ingots made of commercial-grade Ti (Table 6). Plasticity and impact toughness of alloys are correspondingly varying.

This Example analyzed the effect of the prior art and inventive melting modes on the chemical homogeneity of alloying elements distribution in the ingot metal (see Table 7). Electrodes made of spongy Ti with alloying additives were melted to produce 160 mm diameter ingots. It can be seen from results of chemical analysis of Al and V contents in the ingots given in Table 7 that the composition over the total length of ingots produced in melting modes of the invention was characterized by homogeneity. Metal of various portions of the ingots made with the use of prior art modes was characterized by insufficient uniformity of alloying elements distribution.

TABLE 6

| Item No. | Melting mode | Ingot diameter, mm | Sampling location | Gas composition, mass % O | N | H | Reduction of area, % | Elongation % | Impact Toughness, J/cm$^2$ |
|---|---|---|---|---|---|---|---|---|---|
| 1 | 1-1 | 160 | bottom | 0.13 | 0.05 | 0.008 | 58.7 | 27.1 | 197 |
| 2 | | | middle | 0.12 | 0.04 | 0.007 | 63.2 | 29.3 | 241 |
| 3 | | | top | 0.11 | 0.04 | 0.006 | 76.5 | 33.0 | 285 |
| 4 | 2-1 | | bottom | 0.11 | 0.03 | 0.005 | 74.0 | 32.5 | 279 |
| 5 | | | middle | 0.11 | 0.04 | 0.006 | 76.1 | 33.7 | 287 |
| 6 | | | top | 0.11 | 0.03 | 0.005 | 75.2 | 34.1 | 283 |
| 7 | 1-2 | 250 | bottom | 0.12 | 0.05 | 0.007 | 60.3 | 28.5 | 205 |
| 8 | | | middle | 0.11 | 0.04 | 0.006 | 64.8 | 30.6 | 253 |
| 9 | | | top | 0.10 | 0.03 | 0.005 | 75.9 | 34.2 | 291 |
| 10 | 2-2 | | bottom | 0.10 | 0.03 | 0.005 | 76.0 | 33.1 | 289 |
| 11 | | | middle | 0.11 | 0.04 | 0.005 | 74.4 | 32.9 | 297 |
| 12 | | | top | 0.10 | 0.03 | 0.005 | 75.8 | 34.3 | 294 |

TABLE 7

| Item No. | Melting mode | Sampling location | Ti-3 Al alloy Al, mass % | Ti-6Al-4V alloy Al, mass % | V, mass % |
|---|---|---|---|---|---|
| 1 | 1-3 | bottom | 2.6 | 5.3 | 3.7 |
| 2 | | middle | 2.7 | 5.7 | 3.8 |
| 3 | 1-5 | top | 3.0 | 6.1 | 4.0 |
| 4 | 2-3 | bottom | 2.9 | 5.8 | 3.9 |
| 5 | | middle | 3.1 | 6.1 | 4.0 |
| 6 | 2-5 | top | 3.0 | 6.2 | 4.0 |

EXAMPLE 6

The effect of argon pressure on plasticity and toughness of commercial-grade Ti melted with the use of three fluoride-chloride fluxes was studied in this example.

As shown in Table 8, six ingots 160 mm in diameter were melted from commercial-grade Ti with the use of three fluxes of various compositions. Each flux was used for melting 2 ingots, while utilizing minimum and optimum argon pressures in the chamber and crystallizer. With minimum gas pressure, intense volatilization of chlorides took place; formation of ingots was poor, and plasticity and impact toughness values of the metal were low. In the case of optimum argon pressures, the chlorides did not evaporate from the slag pool, formation of ingots was good, and plasticity and impact toughness values of Ti complied with specifications.

TABLE 8

| Item No. | Flux | Ar pressure, $10^5$ Pa | Elongation, % | Reduction of area, % | Impact toughness, J/cm$^2$ |
|---|---|---|---|---|---|
| 1 | 80 mass % $CaF_2$- | 1.1 | 16.5 | 37.7 | 183 |
| 2 | 20 mass % $CaCl_2$ | 1.7 | 27.9 | 69.5 | 261 |
| 3 | 85 mass % $BaF_2$- | 1.3 | 18.3 | 43.9 | 194 |
| 4 | 15 mass % $CaCl_2$ | 1.8 | 28.7 | 74.2 | 287 |
| 5 | 58 mass % $CaF_2$- | 1.9 | 20.3 | 45.1 | 171 |
| 6 | 42 mass % KCl | 3.0 | 27.3 | 71.6 | 263 |

Thus, due to utilization of the method and apparatus of the invention, it was possible to produce a metal that was substantially homogeneous and substantially free of gas admixtures, while being characterized by high plasticity and impact toughness. It is noted that the metal did not contain any pores or inclusions. This fact, combined with chemical and physical homogeneity, provided high performance parameters of resulting metal.

Continuous and intense magnetohydrodynamic stirring of metal results not only in activation of titanium refinement by slag, but also substantially uniform distribution of light and heavy alloying additives throughout the metal. There is no need to carry out repeated melting of titanium and low-alloy titanium-based alloys since the quality obtained upon the first melting procedure does not differ significantly from that of the second melting.

An important economic advantage of the inventive method is the ability to utilize less purified (cheaper) titanium for electrode production. The basis for this substitution comprises metal refinement by slag in the course of melting in accordance with the method of the invention.

While the invention has been described and illustrated herein in terms of the preferred embodiments, it is to be understood that various modifications may be introduced without departing from the scope of the invention as defined by the accompanying claims. Thus, according to the inventive method, other refractory metals and alloys may be melted, particularly zirconium and zirconium-based alloys, and stainless Cr—Ni steels.

I claim:

1. A method of melting titanium and titanium-based alloys comprising the steps of:

providing a consumable electrode in electrical contact with a crystallizer filled with an amount of flux;

evacuating a crystallizer melting area and developing a gauge pressure of inert gas therein;

passing electric current through said consumable electrode,causing the melting of said flux and said consumable electrode and resulting in the production of a melt thereof, said melt including a slag pool and a metal pool;

stabilizing the conditions for uniform distribution of flows of a current-carrying fluid, resulting in a uniform hydrodynamic structure of the melt;

maintaining a constant feed rate of said consumable electrode for crystallizing a metal ingot at the interface with said metal pool at a substantially constant rate of crystallizing over the total length of an ingot to be formed as said metal pool is replenished through melting of said consumable electrode; and withdrawing the ingot from said crystallizer in which under a gauge pressure in the crystallizer melting area within the range of $1.1 \cdot 10^5$ to $2.0 \cdot 10^5$ Pa, the flux composition is selected to contain $CaF_2$ and $CaCl_2$.

2. A method of melting titanium and titanium-based alloys comprising the steps of:

providing a consumable electrode in electrical contact with a crystallizer filled with an amount of flux;

evacuating a crystallizer melting area and developing a gauge pressure of inert gas therein;

passing electric current through said consumable electrode, causing the melting of said flux and said consumable electrode and resulting in the production of a melt thereof, said melt including a slag pool and a metal pool;

stabilizing the conditions for uniform distribution of flows of a current-carrying fluid, resulting in a uniform hydrodynamic structure of the melt;

maintaining a constant feed rate of said consumable electrode for crystallizing a metal ingot at the interface with said metal pool at a substantially constant rate of crystallizing over the total length of an ingot to be formed as said metal pool is replenished through melting of said consumable electrode; and withdrawing the ingot from said crystallizer in which under a gauge pressure in the crystallizer melting area within the range of $2.0 \cdot 10^5$ to $3.6 \cdot 10^5$ Pa, the flux composition is, selected to contain $CaF_2$ and KCl.

3. A method of melting titanium and titanium-based alloys comprising the steps of:

providing a consumable electrode in electrical contact with a crystallizer filled with an amount of flux;

evacuating a crystallizer melting area and developing a gauge pressure of inert gas therein;

passing electric current through said consumable electrode, causing the melting of said flux and said consumable electrode and resulting in the production of a melt thereof, said melt including a slag pool and a metal pool;

stabilizing the conditions for uniform distribution of flows of a current-carrying fluid, resulting in a uniform hydrodynamic structure of the melt;

maintaining a constant feed rate of consumable electrode for crystallizing a metal ingot at the interface with said metal pool at a substantially constant of crystallizing over the total length of an ingot to be formed as said metal pool is replenished through melting of said consumable electrode; and withdrawing the ingot from said crystallizer in which under a gauge pressure in the melting crystallizer melting area within the range of $1.4 \cdot 10^5$ to $2.0 \cdot 10^5$ Pa, the flux composition is selected to contain $BaF_2$ and CaCl2.

* * * * *